United States Patent [19]

Tecca et al.

[11] Patent Number: 4,754,996

[45] Date of Patent: Jul. 5, 1988

[54] SCUBA TANK HOLDER AND CARRIER

[76] Inventors: Frank G. Tecca, 4944 Roja; Jonathan N. Weeks, 3853 San Ramon Dr., #223, both of Oceanside, Calif. 92056

[21] Appl. No.: 103,720

[22] Filed: Oct. 2, 1987

[51] Int. Cl.[4] ..... B65D 25/128; B65D 63/18

[52] U.S. Cl. ..... 294/151; 294/31.2; 294/165; 294/169

[58] Field of Search ..... 294/151, 165, 169, 137, 294/146, 148, 149, 153, 154, 155, 156, 157, 170, 141, 142, 143, 166, 167, 168, 150, 31.2, 27.1, 15; 16/110 R, 114 R, 119, 124, 125, 126; 206/446, 317, 413; 215/100 A; 248/499, 313

[56] References Cited

U.S. PATENT DOCUMENTS

| | | | |
|---|---|---|---|
| 2,936,992 | 5/1960 | Browning | 248/361 |
| 3,817,435 | 6/1974 | De Luca et al. | 224/45 |
| 3,921,872 | 11/1975 | Buell, Jr. | 224/45 |
| 4,140,257 | 2/1979 | Peterson | 224/49 |
| 4,345,789 | 8/1982 | Garnett | 294/31.2 |
| 4,458,933 | 7/1984 | Thomas | 294/31.2 |
| 4,463,978 | 8/1984 | Mountain et al. | 294/31.2 |
| 4,556,245 | 12/1985 | Gruenwald | 294/31.2 |
| 4,560,193 | 12/1985 | Beebe | 294/31.2 |

*Primary Examiner*—James B. Marbert
*Attorney, Agent, or Firm*—Baker, Maxham & Jester

[57] ABSTRACT

A tank mount and carrier comprises a holder in the form of a cradle for receiving the tank and having outward extending legs for stable support of the tank, a band at each end of the cradle extends around the tank to attach it to the mount, with a pair of flexible straps extending along each side and for coming together above the tank for attachment and for forming a handle for carrying the tank.

20 Claims, 1 Drawing Sheet

FIG. 1
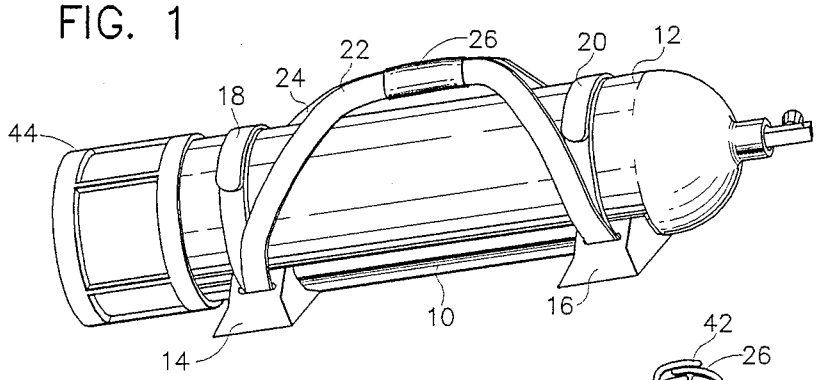
FIG. 2
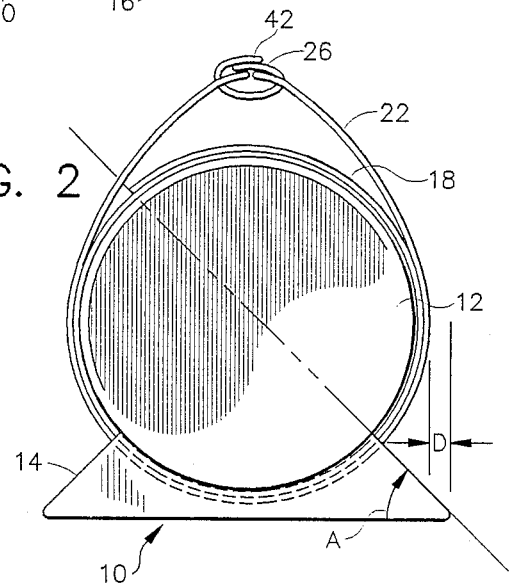
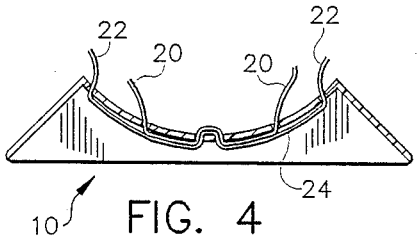
FIG. 4
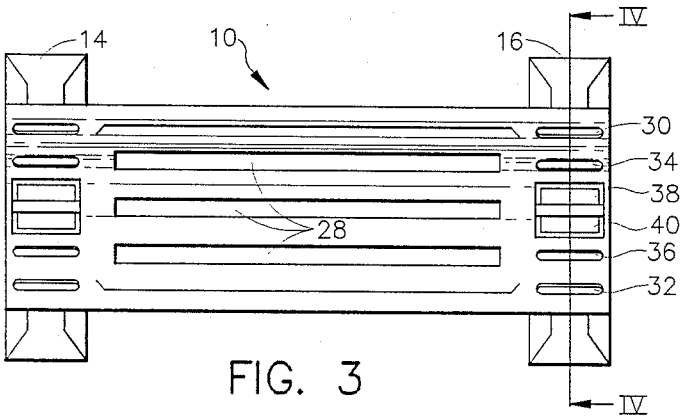
FIG. 3

SCUBA TANK HOLDER AND CARRIER

BACKGROUND OF THE INVENTION

The present invention relates to self underwater breathing apparatus (SCUBA) gear and pertains particularly to an improved holder and carrier for a SCUBA tank.

SCUBA tanks are cylindrical in configuration and have a fitting at one end for attachment of a regulator and valve assembly. These tanks are awkward to carry because of their size, configuration and weight.

Many proposals and attempts have been made in the past to provide some means for overcoming this problem. Most of these attempts have been in the form of a handle attached to the tank by means of a band or strap. Other proposals have included harnesses or straps. These have been helpful but not entirely satisfactory for handling and holding tanks for transport or storage.

It is desirable to have some simple and effective means for holding SCUBA tanks for transport and storage and provide convenient means for carrying the tank.

SUMMARY AND OBJECTS OF THE INVENTION

It is the primary object of the present invention to provide simple and effective means for holding a SCUBA tank for transport and storage and means for carrying the tank.

In accordance with a primary aspect of the present invention, a combination tank holder and carrier comprises a curved base having extended feet for stability, with releasable straps for strapping to the tank and having carrying straps attached to the base with means for securing them together and forming a carrying grip.

BRIEF DESCRIPTION OF THE DRAWING

The above and other objects and advantages of the present invention will become apparent from the following description when read in conjunction with the accompanying drawings wherein:

FIG. 1 is a perspective view illustrating a preferred embodiment of the present invention;

FIG. 2 is an end view of the embodiment of FIG. 1;

FIG. 3 is a top plan view of the base of FIG. 1 with the tank and straps omitted; and FIG. 4 is a section view taken on lines IV-IV of FIG. 3.

DETAILED DESCRIPTION OF A PREFERRED EMBODIMENT

Referring to FIG. 1 of the drawing, a SCUBA tank holder and carrier in accordance with a preferred embodiment of the invention is generally illustrated. The illustrated embodiment comprises an elongated and curved base member, designated generally by the numeral 10, for extending along longitudinally of a cylindrical tank 12, and having a curvature for partially encircling a side of the cylindrical tank. The curvature of the base is preferably the same as that of the tank for snug fit thereof. The axis of curvature of the tank and base thus coincide. The base or cradle member has a pair of feet 14 and 16, one at each end of the base or cradle member for supporting the holder on a support surface. The feet members are preferably as illustrated in FIG. 2, with a width that exceeds the width of the tank by an amount, such as a dimension D that positions the outer most tip at each side, sufficient that an angle extending through the outermost edge of the foot and the center of the tank would be less than forty-five degrees to the horizontal. This provides a wide stable support platform to prevent the tank from tipping or rolling in a usual situation, such as when being carried in a trunk of a vehicle at alike.

A pair of a tank encircling straps 18 and 20 extend through slots in the base member (FIG. 4) and around the tank for releasably securing the tank in position on the base.

A pair of carrying straps 22 and 24 extend to each side and can be brought together above the tank (FIGS. 1 and 2) to form a handle. They straps, in the preferred form, comprise a single strap that is extended through slots at both ends of the cradle and brought together and secured at its ends, such that it forms two loops 22 and 24, one at each side of the tank. These loops extend above the tank as shown in (FIG. 2) where they are brought together and releasably secured at the top by a fabric pad 26 of a generally rectangular configuration. This pad 26 is secured at one edge to one of the loops 22 and 24 and is provided with VELCRO (Trademark) type hook and loop fastening means along overlapping edges 42 for detachably securing around the loops of the carrying strap.

Referring particularly to FIG. 3, the holder is constructed in a manner and configured such that it may be preferably formed by molding of a suitable plastic material. The holder can be configured such that it can be molded, for example, by injection molding or by vacuum molding. It is also of a configuration and arrangement that can also be constructed of sheet metal, for example, by either stamping or by a combination of stamping and welding.

The holder, as generally shown for example in FIGS. 3 and 4, comprises a main section comprising a generally rectangular curved cradle member 28, curved to fit the side of a tank and provide a center with a plurality of elongated drain slots 28. These drain away water from the tank and permit air to circulate to the surface of the tank to dry it and reduce the potential for corrosion.

Each end of the cradle member includes identical pairs of strap slots arranged to accommodate both the tank strap and the carrying strap. These include an outer pair of slots 30 and 32 for receiving the carrying strap, with an intermediate pair of slots 34 and 36 for receiving the tank straps and center slots 38 and 40, which receive both of the carrying straps and the tank straps.

Referring more particularly to FIG. 4, both straps extend through the slots 38 and 40. With this arrangement, the tank straps are positioned such that they engage the tank around almost its entire periphery to enhance the securement thereof. The straps are thus woven through the slots as shown in FIG. 4.

It will be appreciated as viewed in (FIG. 1) that the base member has a length that extends over a major portion of the length of the tank. This secures the tank close to both ends thereof and provides a long stable support platform for the tank.

Referring back to FIG. 2, the grip pad 26, as shown, is preferably secured such as by sewing or the like to the strap portion 22 at one side thereof. The pad 26 is provided with VELCRO hook and loop fastening means at overlapping side edges at 42, such that the pad can be secured and released as desired. The pad can be released so that the loops of the carrying strap can be separated and laid aside to easily lift the tank 12 directly upward out of the holder. The straps 18 and 20 may also be provided with either conventional tank strap buckles or with VELCRO type fastening means as desired.

A boot 44 may also be placed on the end of the tank while it is being supported or carried in the holder and carrier.

In operation, the base is place or rested on a generally horizontal support surface with the straps 18 and 20 and the carrying straps 22 and 24 released and lying to the side. A tank is placed in the base with the top extending beyond the end, as shown in FIG. 1, and the straps 18 and 20 fastened and secured tight around the tank to securely hold it in place. The carrying straps 22 and 24 are then brought together above the tank, and the grip pad 26 is wrapped around the adjacent strap and a VELCRO type fastening means is engaged to secure the strap together. The carrier and tank in that configuration can then be easily lifted and carried with the tank in substantially horizontal position as shown in FIG. 1. The tank may also be placed in the cargo space of the vehicle, and due to its wide base, will be very secure against rolling about under generally normal conditions. The tank can thus be carried from the vehicle to the diving site and the tank rested on the holder on the ground until ready to be mounted on the diver.

When the diver has completed his diving and is ready to return his equipment to the vehicle, he removes the tank from his harness and places it in the carrier holder and straps it in place. The open bottom of the holder enables the water on the tank to drain out and allows the tank to dry, thereby avoiding or at least reducing corrosion of the tank as a result of moisture. The tank can then be carried back to the vehicle in the manner as previously described.

While we have illustrated and described our invention by means of specific embodiments, is to be understood that numerous changes and modifications may be made therein without departing from the spirit and scope of the invention as defined in the appending claims.

We claim:

1. A holder and carrier for a SCUBA tank and the like, comprising:

an elongated curved base member for extending along longitudinally of a cylindrical tank and having a curvature for partially encircling a side of said cylindrical tank;

a foot at each end of said base member, each foot extending outward beyond said base and having a width exceeding that of the cylindrical tank to be carried;

a pair of tank securing straps, one at each end of said base for extending around and securing said base to a tank; and a pair of carrying straps, one at each side of said base and extending between and connected to the ends thereof and having a length for extending together above a tank for simultaneous grasping in one hand.

2. A holder and carrier according to claim 1 wherein:

said base includes a plurality of parallel slots at each end thereof for receiving said tank straps and said carrying straps.

3. A holder and carrier according to claim 1 wherein:

said base includes a plurality of drain slots extending longitudinally therein between said ends.

4. A holder and carrier according to claim 1 wherein:

said carrying straps comprises a unitary web strap extending through slots at the ends of said base and connected together at the ends to form said carrying straps.

5. A holder and carrier according to claim 1 wherein:

said base and said feet are a unitary structure molded of a durable plastic.

6. A holder and carrier according to claim 1 wherein:

said base and said feet are a unitary structure formed of a durable metal.

7. A holder and carrier according to claim 2 wherein:

said slots are formed in pairs with an outermost pair for said carrying strap, an intermediate pair for said tank strap, and a center pair for receiving both said carrying strap and said tank strap.

8. A holder and carrier according to claim 2 wherein:

said base includes a plurality of drain slots extending longitudinally therein between said ends.

9. A holder and carrier according to claim 8 wherein:

said carrying straps comprise a unitary web strap extending through slots at the ends of said base and connected together at the ends to form said carrying straps.

10. A holder and carrier according to claim 9 wherein:

said base and said feet are a unitary structure molded of a durable plastic.

11. A holder and carrier according to claim 9 wherein:

said base and said feet are a unitary structure formed of a durable metal.

12. A holder and carrier according to claim 11 wherein:

said slots are formed in pairs with an outermost pair for said carrying strap, an intermediate pair for said tank strap, and a center pair for receiving both said carrying strap and said tank strap.

13. A holder and carrier for a SCUBA tank and the like, comprising:

an elongated curved base member having a longitudinal axis for extending along longitudinally of a cylindrical tank and having a curvature for engagement with and partially encircling a side of said cylindrical tank;

a foot at each end of said base member, each foot extending outward beyond said base and having a width exceeding the diameter of a cylindrical tank to be carried;

a pair of tank securing straps, one at each end of said base for extending around and securing said base to a tank; and a pair of carrying straps, one at each side of said base and extending between and connected to the ends thereof and having a length for extending together above a tank for simultaneous grasping in one hand.

14. A holder and carrier according to claim 13 wherein:

said base includes a plurality of pairs of parallel slots at each end thereof for receiving said tank straps and said carrying straps.

15. A holder and carrier according to claim 14 wherein:

said base includes a plurality of drain slots extending longitudinally therein between said ends.

16. A holder and carrier according to claim 15 wherein:

said carrying straps comprise a unitary web strap extending through slots at the ends of said base and connected together at the ends to form said carrying straps.

17. A holder and carrier according to claim 16 wherein:

said base and said feet are a unitary structure and said feet have a width sufficiently exceeding the diameter of a tank to be carried so that a line through the axis of the tank and the outer edge of the foot forms an angle with the horizontal that is no greater than forty-five degrees.

18. A holder and carrier according to claim 17 wherein:

said slots are formed in pairs with an outermost pair for receiving said carrying strap, an intermediate pair for receiving said tank strap, and a center pair for receiving both said carrying strap and said tank strap.

19. A SCUBA tank holder and carrier for securing and carrying a SCUBA tank and the like, comprising:

an elongated curved base member having a longitudinal axis for extending along longitudinally of a cylindrical tank and having a curvature for engagement with and partially encircling a side of said cylindrical tank;

a plurality of drain slots extending longitudinally therein between said ends;

a foot at each end of and integral with said base member, each foot extending outward beyond said base and having a width exceeding the diameter of a cylinder to be carried;

a plurality of pairs of parallel slots at each end thereof for receiving tank securing straps and carrying straps, said slots are formed in pairs with an outermost pair for receiving said carrying strap, an intermediate pair for receiving said tank strap, and a center pair for receiving both said carrying strap and said tank strap;

a pair of tank securing straps, one at each end of said base extending through an inner pair and an intermediate pair of said slots for extending around and securing said base to a tank; and a pair of carrying straps, one at each side of said base and extending between and connected via said outer pair of slots and said inner slots to the ends thereof, and having a length for extending together above a tank for simultaneous grasping in one hand, said carrying straps comprise a unitary web strap extending through said slots at the ends of said base and connected together at the ends to form said carrying straps.

20. A SCUBA tank holder and carrier according to claim 19 wherein:

said base and said feet are a unitary structure and said feet have a width sufficiently exceeding the diameter of a tank to be carried do that a line through the axis of the tank and the outer edge of the foot forms an angle with the horizontal that is no greater than forty-five degrees.

* * * * *